US005311707A

United States Patent [19]

LaRoche et al.

[11] Patent Number: 5,311,707

[45] Date of Patent: May 17, 1994

[54] SHOWER ENCLOSURE

[75] Inventors: Joel A. LaRoche; William J. Critchley; Steve G. Mardero, all of Winnipeg, Canada

[73] Assignee: Fiat Products Ltd., Winnipeg, Canada

[21] Appl. No.: 11,240

[22] Filed: Jan. 29, 1993

[51] Int. Cl.[5] ..... A47K 3/16

[52] U.S. Cl. ..... 52/35; 4/584; 4/614; 4/612

[58] Field of Search ..... 52/34, 35; 4/612-614, 4/583, 584

[56] References Cited

U.S. PATENT DOCUMENTS

| | | | |
|---|---|---|---|
| 1,366,955 | 2/1921 | Schneible | 403/337 X |
| 3,149,187 | 1/1961 | Wood . | |
| 3,479,778 | 11/1969 | Johnson . | |
| 3,835,480 | 9/1974 | Harding . | |
| 3,858,987 | 1/1975 | Kleinhans | 403/2 |
| 4,080,710 | 3/1978 | Hess . | |
| 4,109,426 | 8/1978 | Dobija . | |
| 4,316,295 | 2/1982 | Whitney | 52/34 X |
| 4,365,368 | 12/1982 | Boggs . | |
| 4,384,377 | 5/1983 | Calvert | 52/34 X |
| 4,471,501 | 9/1984 | Heymann . | |
| 4,553,276 | 11/1985 | Paradis | 52/35 X |
| 4,578,832 | 4/1986 | Primucci | 4/614 |
| 4,671,026 | 6/1987 | Wissinger | 52/35 |
| 4,691,392 | 9/1987 | Whitney | 52/35 X |
| 4,817,344 | 4/1989 | Wissinger | 52/35 |
| 4,901,380 | 2/1990 | Smith | 52/35 X |
| 4,987,619 | 1/1991 | Smith | 52/34 X |

FOREIGN PATENT DOCUMENTS 1157602 11/1983 Canada .

*Primary Examiner*—Carl D. Friedman
*Assistant Examiner*—Beth A. Aubrey
*Attorney, Agent, or Firm*—Adrian D. Battison; Stanley G. Ade; Murray E. Thrift

[57] ABSTRACT

A joint between an upper wall part and a lower wall part of a modular tub/shower unit includes a recessed band adjacent to but spaced from the lowermost edge of the upper wall part. A further band is recessed at the uppermost edge of the lower wall part with the vertical height of that band being greater than the vertical height of the recessed band in the upper wall part and greater than a band at the lowermost edge which is not recessed. The lowermost band of the upper wall part is then adhesively attached to the uppermost edge and a part of the recessed band of the part by a double sided adhesive tape the covering of which is pulled through the gap between these parts. The adhesive tape provides the only sealant necessary for waterproofing the joint and provides the only structural strength necessary. The groove above the lowermost band of the upper wall part allows the upper wall part to be maneuvered into the required position by finger engagement into the groove. The recessed bands adjacent the upper and lower edges of the parts provide stiffening strength.

19 Claims, 2 Drawing Sheets

SHOWER ENCLOSURE

The invention relates to a shower enclosure and particularly but not exclusively to a modular tub, tub surround and shower enclosure which is formed in three separate pieces, separated by horizontal joints, the invention being directed particularly to the lap joint formed between the parts of the shower enclosure.

It is well known in the manufacture of bathroom fittings to manufacture a modular tub/shower unit which includes a tub portion at the bottom, a rear wall which is integral with the tub portion and extends upwardly therefrom and two side walls which are again integral with the tub portion and extend upwardly therefrom at each end of the tub. At the top of the rear and side walls is provided a top wall again as an integral construction. This allows the whole structure to be inserted into the cavity of a wall to form a completely waterproof surround into which a bather can step to use the tub or to shower with the water falling into the tub. The fully enclosed waterproof structure is highly advantageous in that it prevents the escape of water into the wall cavity despite the shower spraying water onto the surrounding walls.

In initial installation of such a modular tub/shower arrangement in a new building, the modular unit can be brought into place at an early stage in the construction of the walls so that it is possible to maneuver the relatively large and cumbersome structure through the building without dismantling doors, walls, or the like. However in a renovation project, often the walls, doors, stairways and the like are already constructed and it is difficult to the transport the modular unit as a single construction through the building to the required location.

It has become accepted, therefore, that manufactures of this type of construction will manufacture both the single piece unit for a new installation and a three piece unit which is manufactured for renovation projects. The three piece unit is divided by horizontal joint lines to form a top piece which includes a top wall, the rear wall and two side walls; a centre piece which simply includes the rear wall and two side walls; and a bottom piece which includes the tub structure and a small portion of the rear and side walls. Generally, the centre piece is of greater height than the top and bottom pieces since this piece is more maneuverable.

One problem which has always arisen with products of this type is that of forming a suitable joint between the top, middle and bottom pieces. Various different styles of joint have been used including butt joints and lap joints although in many cases additional connecting elements are positioned rearwardly of the wall to clamp the wall pieces together; but these are disadvantageous in that it is necessary to access these rear coupling elements.

One example of a lap joint of this type is shown in U.S. Pat. No. 4,578,832 (Primucci) which includes a lap joint section with an upper part diverted outwardly to engage over the lower part. An additional coupling element is positioned between the parts to help maintain them attached. Fastening blocks are mounted on the outside surface to assist in clamping the pieces together.

A further example is shown in U.S. Pat. No. 4,080,710 (Hess). This discloses effectively a butt joint in which the lower part includes a rear leg which is turned upwardly behind the butt joint to prevent the escape of moisture. Two flanges at the butt joint are then clamped together by fasteners.

It is one object of the present invention to provide an improved joint system for a modular tub/shower of the above type.

According to the invention there is provided a shower enclosure comprising a wall assembly including a rear wall and at least one side wall, said wall assembly being divided at a horizontal joint into an upper wall part and a lower wall part for separate transportation into an installation location and for subsequent connection together at the horizontal joint to form the complete wall assembly, each of the upper wall part and the lower wall part including a respective portion of the rear wall and of the at least one side wall, the wall assembly having an inner surface facing inwardly and forwardly and an outer surface facing outwardly and rearwardly, the lower wall part having an upper most edge at the horizontal joint and the upper wall having a lowermost edge at the horizontal joint, and lap joint means defining a lap joint between the upper wall part and the lower wall part at the horizontal joint, said lap joint means comprising a horizontal recessed band defined in the upper wall part adjacent to but spaced from the lowermost edge thereof and having a base of the recessed band displaced outwardly and a bottom edge of the recessed band turned inwardly from the base, a first horizontal band portion of the upper wall part connected to the bottom edge of the recessed band and thus extending between the recessed band and the lowermost edge, which is displaced inwardly relative to the base of the recessed band, a portion of the upper wall part adjacent to and above the recessed band which is displaced inwardly relative to the base of the recessed band, a second horizontal band portion of the lower wall part at the uppermost edge thereof which is displaced outwardly relative to the first horizontal band portion, the second horizontal band portion being overlapped with the first horizontal band portion to as to lie outwardly thereof with the uppermost edge in contact with the outer surface of the bottom edge of the recessed band, and sealing means bonding the outer surface of the first horizontal band portion to the inner surface of the second horizontal band portion.

One embodiment of the invention will now be described in conjunction with the accompanying drawings in which:

DETAILED DESCRIPTION

Figure 1:
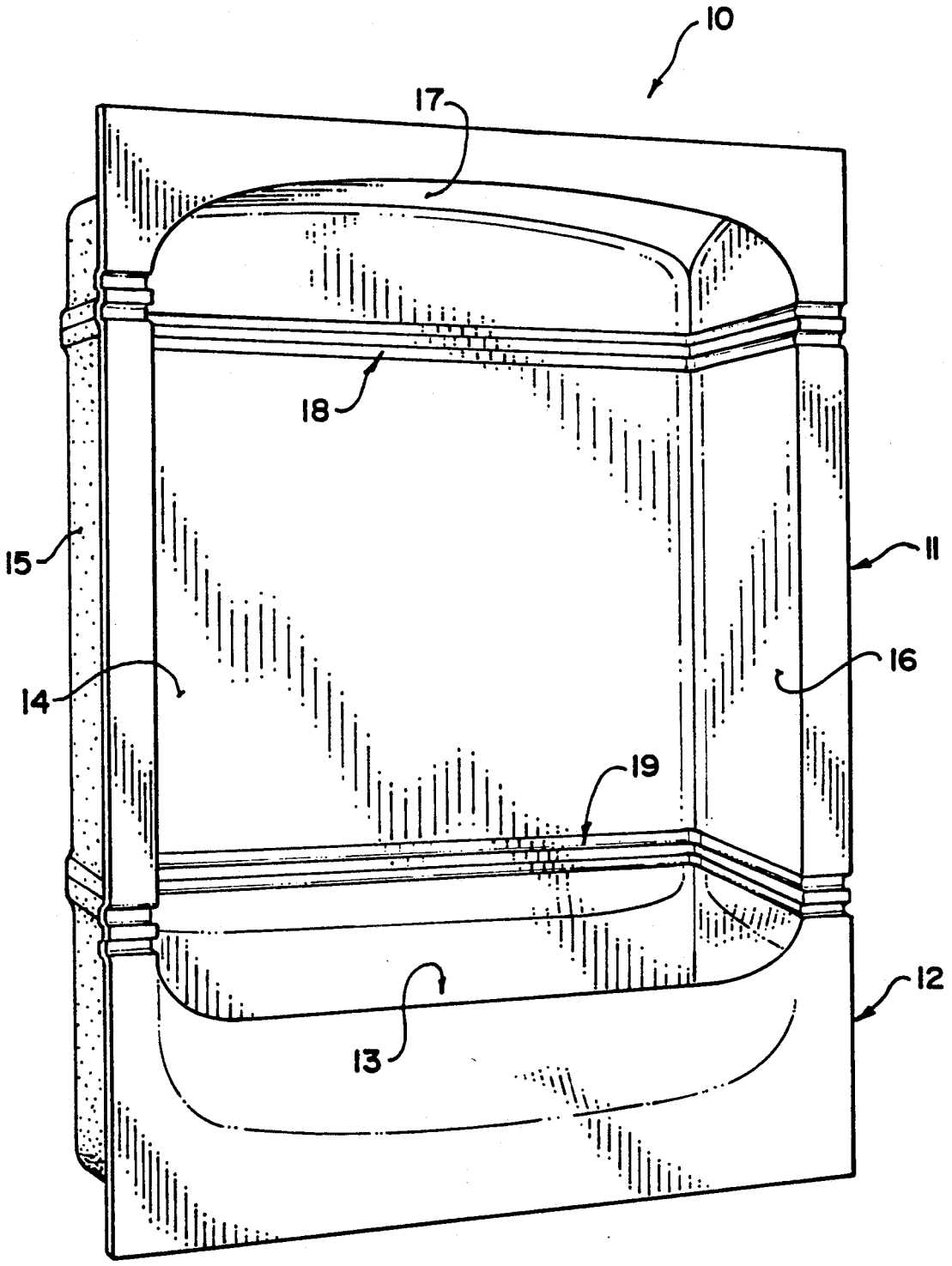
FIG. 1 is an isometric view of an assembled modular tub/shower unit according to the present invention.

A modular tub/shower unit is shown in FIG. 1 and comprises generally a top part 10, a centre part 11 and a bottom part 12. The completed unit includes a bottom tub section 13 together with a rear wall 14, a first side wall 15 and a second side wall 16. At the top part is also a top wall 17. In the completely assembled unit, the tub and walls are effectively integral so as to prevent the escape of water around the tub and between the walls.

However for the manufacture of a renovation project, the tub/shower unit is manufactured in the three separate pieces 10, 11 and 12 connected together at joint lines 18 and 19.

In the examples shown, the tub/shower unit is manufactured from an acrylic material 20 which forms an inside layer and this is covered on the outside by a mat 21 of a glass fibre reinforced resin material in conventional manner. The technique for manufacturing includes initially the vacuum forming the acrylic layer to form a substantially rigid structure of the required shape following which the acrylic layer is reinforced by the application onto the outside surface of the resin and chopped fibres to form the glass fibre reinforcement.

These techniques of manufacture and the general construction of the modular tub/shower unit are well known, the improvement of the present invention relating to the construction of the joint which is shown schematically in FIG. 1 but is shown in more detail in FIGS. 2 through 5.

Figure 5:
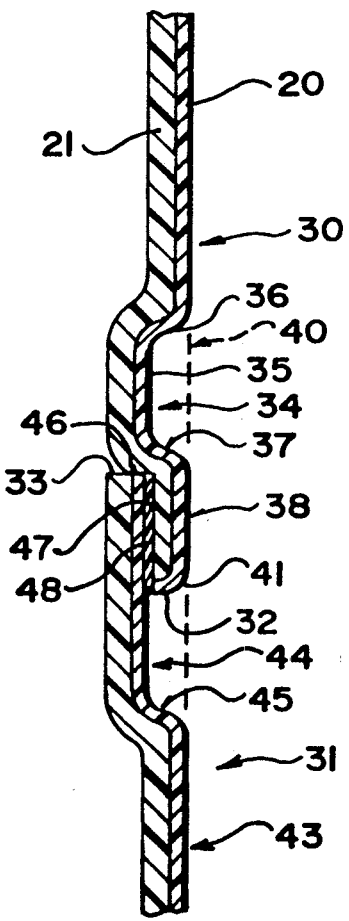
FIG. 5 is a cross-sectional view similar to that of FIG. 2 showing the finished joint.

Referring firstly to the finished joint structure shown in FIG. 5, the joint includes an upper wall part generally indicated at 30 and a lower wall part generally indicated at 31. It will be appreciated that the joints 18 and 19 are effectively identical so the joint shown in FIG. 5 constitutes one of those joints. The wall parts 30 and 31 and therefore are simply generically shown for purposes only of describing the joint.

The upper wall part 30 includes a lowermost edge 32 and the lower wall part 31 includes an uppermost edge 33. At a positioned spaced from the lowermost edge 32, the upper wall part includes a recessed horizontal band 34 including a base 35, an upper edge 36 and a lower edge 37. The recess is formed in both the inner layer 20 and the rear or outer reinforcing layer and has a depth approximately equal to the total depth of those two layers. The recessed band thus forms a hollow recess on the inner surface and a rib on the outer surface.

Between the lower edge 37 of the recessed band and the lowermost edge 32 is provided a first horizontal band 38 which in the example shown has a vertical height substantially equal to that of the base of the recess 34. The inside surface of the first horizontal band 38 lies in a common vertical plane with the main portion of the upper wall part 30 so that the recess is recessed from that common vertical plane indicated at 40. The lowermost edge 32 is formed by a convex curved part 41 of the inner surface and is defined by a portion of the inner layer 20 which is curved through 90° so as to terminate immediately adjacent the lower wall part 31.

The lower wall part 31 includes a main wall portion 43 and a second recessed band 44 which commences at a lower edge 45 and extends therefrom upwardly to the uppermost edge 33. The vertical height of the band 44 is greater than that of the first horizontal band 38 by a distance approximately equal to the vertical height of the recessed band 34. The amount of the recess of the band 44 relative to the vertical surface of the main portion 43 is substantially equal to the amount of recess to the recessed band 34. The outside surface of the first band 38 and the outside surface of the bottom edge 37 are both machined as indicated at 46, 47 to form flat surfaces at right angles to accurately receive the inside surface of the band 44 and the uppermost edge 33. Between the outside surface of the band 38 and the inside surface of the band 44 is provided a double sided adhesive tape 48 which bonds together those two surfaces in fixed position.

In the finished joint, the double sided adhesive tape constitutes the only sealing means to prevent the escape of moisture. Thus there is no need for additional silicone or similar type sealant beads to be added since moisture will tend to run down the upper wall part and is limited in its ability to move upwardly through the lap joint and is prevented from passing through that lap joint by the strong adhesive effect provided by the double sided adhesive tape.

In addition the double sided adhesive tape and the interconnection at the lap joint constitute the only structural members providing the interconnection at the joint. Thus there is no necessity for additional coupling blocks or clamping elements which are located outside the structure.

The recessed band 34 provides an upper edge 36 which allows a user to grasp the upper wall part and lift the upper wall part. The lower edge 37 similarly allows vertical downward movement to be applied to the upper part to bring it into a position in which the machine surfaces 46 and 47 are properly in position against the abutting surfaces of the lower wall part 31. In addition the recessed band 34 provides a stiffening effect at the joint. Furthermore the lower edge 37 provides a stop member locating the uppermost edge 33.

The recessed band 44 similarly provides a stiffening effect at the upper edge of the lower wall part. In addition the space between the lowermost edge 32 and the lower edge 45 of the recessed band provides an attractive appearance in that it matches the recessed band 34 thus providing an appearance of a double groove as shown in FIG. 1. This double groove tends to remove from vision the actual joint line provided at the lowermost edge 32.

This construction has the following advantages.

1. The unit can be installed and assembled in position without access to the back side of the structure.
2. The groove or recess 34 provides a finger grip to enable the user to assemble the sections from the inside.
3. The groove 34 stiffens or strengthens the walls at the joint line.
4. The lap joint system with the upper wall part providing the inner wall ensures a leak proof joint line.
5. The use of the double sided tape provides both the sealing of the joint line without additional sealant and provides the structural strength of the joint line without additional joining elements.

Figure 4:
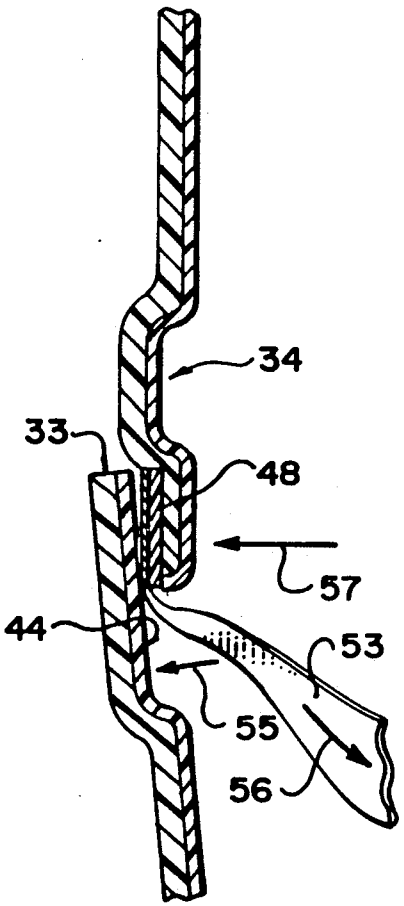
FIG. 4 is a yet further cross-sectional view similar to that of FIG. 2 showing a third step in the formation of the joint.
Figure 3:
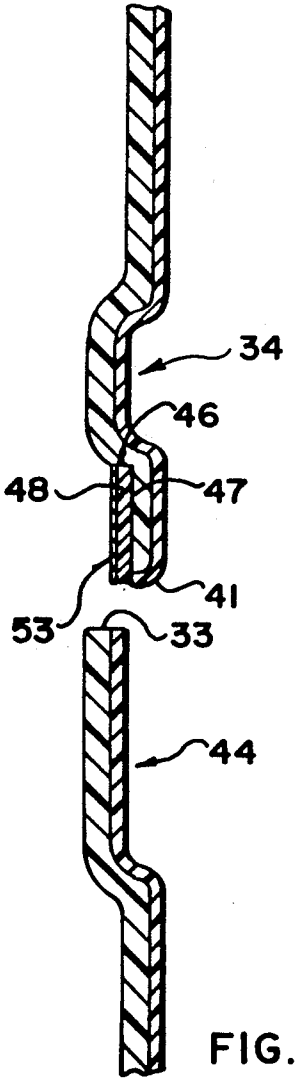
FIG. 3 is a similar cross-sectional view as that of FIG. 2 showing a next step in the formation of the joint.
Figure 2:
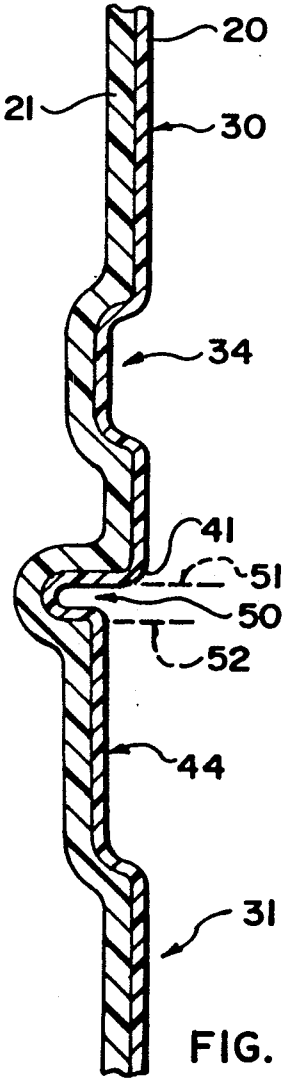
FIG. 2 is a cross-sectional view through one portion of the initial structure of the tub/shower unit prior to formation of the joint.

The steps in manufacture of the joint are shown in FIGS. 2, 3, and 4. In FIG. 2 an initial construction is shown in which the bands 34 and 44 are formed by a molding technique with the addition of a further groove 50 positioned between these bands defining a U-shape section simply as a connector piece to be removed.

In the next step, a cutting blade provides a cutting action along the lines 51 and 52 so as to remove the U-shaped groove 50. It will be noted that the cutting line 51 is positioned just below the curved wall part 41 so as to leave this outwardly curved inside layer portion in tact. The cut line 52 is however positioned slightly lower so as to cut away the outwardly curved portion at that cut line thus forming a directly horizontal blunt cut end at the uppermost edge 33.

After the cutting is complete, a machine tool in the form of a router is applied to the surfaces 46 and 47 to provide the direct right angle straight line surfaces necessary for engagement with the surfaces of the lower wall part.

The next step requires the application of the double sided adhesive tape 47 which is covered by a covering layer 53 on the surface away from the surface 47. The upper wall part can thus be assembled in engagement with the lower wall part for transportation or storage purposes without the adhesive causing a permanent bond.

The next stage in the assembly process is the final installation at the required location at which time the upper wall part and lower wall part are properly assembled after transportation to the necessary location. The user can grasp the upper wall part at the groove or recess 34 to provide upward or downward pressure to move the elements relative to one another to bring the uppermost edge 33 properly into engagement with the surface 46. At this point, one part of the covering layer 53 can be grasped and pulled so it is pulled away from its engagement with the outside surface of the tape 48. As shown in FIG. 4, slight pressure indicated by the arrow 55 at the point of pulling on the tape 53 as indicated at the arrow 56 will cause the lower wall part to distort slightly rearwardly to provide enough of a gap between the upper and lower wall part for the tape or covering layer 53 to be extracted. Once extracted, pressure on the band 38 as indicated at the arrow 57 will cause a final bonding between the adhesive tape and the inside surface of the band 44.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A shower enclosure comprising a wall assembly including a rear wall and at least one side wall, said wall assembly being divided at a horizontal joint into an upper wall part and a lower wall part for separate transportation into an installation location and for subsequent connection together at the horizontal joint to form the complete wall assembly, each of the upper wall part and the lower wall part including a respective portion of the rear wall and of the at least one side wall, the wall assembly having an inner surface facing inwardly and forwardly and an outer surface facing outwardly and rearwardly, the lower wall part having an upper most edge at the horizontal joint and the upper wall having a lowermost edge at the horizontal joint, and lap joint means defining a lap joint between the upper wall part and the lower wall part at the horizontal joint, said lap joint means comprising a horizontal recessed band defined in the upper wall part adjacent to but spaced from the lowermost edge thereof and having a base of the recessed band displaced outwardly and a bottom edge of the recessed band turned inwardly from the base, a first horizontal band portion of the upper wall part connected to the bottom edge of the recessed band and thus extending between the recessed band and the lowermost edge, which is displaced inwardly relative to the base of the recessed band, a portion of the upper wall part adjacent to and above the recessed band which is displaced inwardly relative to the base of the recessed band, a second horizontal band portion of the lower wall part at the uppermost edge thereof which is displaced outwardly relative to the first horizontal band portion, the second horizontal band portion being overlapped with the first horizontal band portion lie outwardly thereof with the uppermost edge in contact with the outer surface of the bottom edge of the recessed band, and sealing means bonding the outer surface of the first horizontal band portion to the inner surface of the second horizontal band portion.

2. The shower enclosure according to claim 1 wherein the second band portion is recessed outwardly relative to an adjacent main body portion of the lower wall part.

3. The shower enclosure according to claim 2 wherein the inside surface of the main body portion of the lower wall part lies in the same vertical plane as said portion of the upper wall part.

4. The shower enclosure according to claim 2 wherein the second band portion has a vertical height greater than that of the first band portion.

5. The shower enclosure according to claim 4 wherein the second band portion has a vertical height greater than that of the first band portion by a distance substantially equal to the vertical height of the recessed band.

6. The shower enclosure according to claim 1 wherein the sealing means comprises a double sided tape carried on one of the outer surface of the first band portion or the inner surface of the second band portion, the double sided tape having a covering layer on an exposed surface thereof, the covering layer being removable between the outer surface of the first band portion and the inner surface of the second band portion subsequent to the mounting of the upper wall part on the lower wall part.

7. The shower enclosure according to claim 6 wherein the double sided tape is carried on the outer surface of the first band portion.

8. The shower enclosure according to claim 6 including means for sealing against penetration of water between the outer surface of the first band portion and the inner surface of the second band portion, said means for sealing consisting solely of the double sided tape.

9. The shower enclosure according to claim 6 including means for fastening the upper wall part to the lower wall part to prevent separation thereof after installation, said means for fastening consisting solely of said double sided tape.

10. The shower enclosure according to claim 1 wherein the outer surface of the first band portion and the outer surface of the bottom edge of the recessed band are cut by a machining tool to form a right angle for receiving the uppermost edge therein.

11. The shower enclosure according to claim 1 wherein the lowermost edge includes an inner surface which is curved convexly so the inner surface extends from the first band portion around the lowermost edge to a position closely adjacent the inner surface of the second band portion.

12. The shower enclosure according to claim 1 wherein the upper wall part and the lower wall part are each formed from a sheet material defining the inner surface and an outer coating material applied on an outer surface of the sheet material and defining the outer surface and wherein the lowermost edge includes an inner surface which is curved convexly so the inner surface extends from the first band portion around the lowermost edge to a position closely adjacent the inner surface of the second band portion.

13. The shower enclosure according to claim 1 including a bottom wall part located beneath the lower wall part, the bottom wall part being divided at a horizontal joint from the lower wall part, each of the upper wall part, lower wall part and bottom wall part including a rear wall and two side walls, the upper wall part including a horizontal top wall and said bottom wall part including a horizontal bottom wall, there being provided lap joint means defining a lap joint between the lower part and the bottom wall part at the horizontal joint therebetween, the lap joint means between the lower wall and the bottom wall part being substantially identical to the lap joint means between the upper wall and lower wall part.

14. A shower enclosure comprising a wall assembly including a rear wall and at least one side wall, said wall assembly being divided at a horizontal joint into an upper wall part and a lower wall part for separate transportation into an installation location and for subsequent connection together at the horizontal joint to form the complete wall assembly, each of the upper wall part and the lower wall part including a respective portion of the rear wall and of the at least one side wall, the wall assembly having an inner surface facing inwardly and forwardly and an outer surface facing outwardly and rearwardly, the lower wall part having an upper most edge at the horizontal joint and the upper wall having a lowermost edge at the horizontal joint, and lap joint means defining a lap joint between the upper wall part and the lower wall part at the horizontal joint, said lap joint means comprising a horizontal recessed band defined in the upper wall part adjacent to but spaced from the lowermost edge thereof and having a base of the recessed band displaced outwardly and a bottom edge of the recessed band turned inwardly from the base, a first horizontal band portion of the upper wall part connected to the bottom edge of the recessed band and thus extending between the recessed band and the lowermost edge, which is displaced inwardly relative to the base of the recessed band, a portion of the upper wall part adjacent to and above the recessed band which is displaced inwardly relative to the base of the recessed band, a second horizontal band portion of the lower wall part at the uppermost edge thereof which is displaced outwardly relative to the first horizontal band portion, the second horizontal band portion being overlapped with the first horizontal band portion lie outwardly thereof with the uppermost edge in contact with the outer surface of the bottom edge of the recessed band, and sealing means bonding the outer surface of the first horizontal band portion to the inner surface of the second horizontal band portion wherein the second band portion is recessed outwardly relative to an adjacent main body portion of the lower wall part and has a vertical height greater than that of the first band portion, wherein the sealing means comprises a double sided tape carried on one of the outer surface of the first band portion or the inner surface of the second band portion, the double sided tape having a covering layer on an exposed surface thereof, the covering layer being removable between the outer surface of the first band portion and the inner surface of the second band portion subsequent to the mounting of the upper wall part on the lower wall part, wherein the outer surface of the first band portion and the outer surface of the bottom edge of the recessed band are cut by a machining tool to form a right angle for receiving the uppermost edge therein and wherein the lowermost edge includes an inner surface which is curved convexly so the inner surface extends from the first band portion around the lowermost edge to a position closely adjacent the inner surface of the second band portion.

15. The shower enclosure according to claim 14 wherein the inside surface of the main body portion of the lower wall part lies in the same vertical plane as said portion of the upper wall part.

16. The shower enclosure according to claim 14 wherein the second band portion has a vertical height greater than that of the first band portion by a distance substantially equal to the vertical height of the recessed band.

17. The shower enclosure according to claim 14 wherein the double sided tape is carried on the outer surface of the first band portion.

18. The shower enclosure according to claim 14 including means for sealing against penetration of water between the outer surface of the first band portion and the inner surface of the second band portion, said means for sealing consisting solely of the double sided tape.

19. The shower enclosure according to claim 14 wherein the upper wall part and the lower wall part are each formed from a sheet material defining the inner surface and an outer coating material applied on an outer surface of the sheet material and defining the outer surface and wherein the lowermost edge includes said inner surface which is curved convexly so the inner surface extends from the first band portion around the lowermost edge to a position closely adjacent the inner surface of the second band portion.

* * * * *